US005762339A

United States Patent [19]

Olson

[11] Patent Number: 5,762,339

[45] Date of Patent: Jun. 9, 1998

[54] REUSABLE BINGO CARDS

[76] Inventor: Harvey Olson, General Delivery, Scanterbury, Manitoba, Canada, R0E 1W0

[21] Appl. No.: 738,091

[22] Filed: Oct. 25, 1996

[51] Int. Cl.[6] ..... A63F 3/06

[52] U.S. Cl. ..... 273/269; 273/240

[58] Field of Search ..... 273/269, 240, 273/270; 283/48.1, 49

[56] References Cited

U.S. PATENT DOCUMENTS 3,618,231 11/1971 Nason ..... 273/240
3,618,951 11/1971 Parrick ..... 273/240
4,630,830 12/1986 Gadd ..... 273/240
4,828,502 5/1989 Leahy .
4,850,595 7/1989 Sherman et al. ..... 273/240
5,037,702 8/1991 Pitts et al. .
5,241,332 8/1993 Farrell .
5,286,025 2/1994 Mulyca et al. ..... 273/240
5,361,164 11/1994 Steliga .

*Primary Examiner*—William M. Pierce
*Attorney, Agent, or Firm*—Murray E. Thrift; Adrian D. Battison

[57] ABSTRACT

A game sheet, for example for the game of bingo is a flexible PVC sheet reverse printed with a set of bingo cards. The front surface of the sheet has an anti-glare finish that accepts solvent-based marks and will also allow the marks to be erased so that the sheet may be reused. The sheets are supplied in books of sheets for multiple games.

6 Claims, 2 Drawing Sheets

REUSABLE BINGO CARDS

FIELD OF THE INVENTION

The present invention relates to a game of sheets, for example sheets of bingo cards, and more particularly to reusable game sheets.

BACKGROUND

In playing the game of bingo, it is conventional for a player to play a single sheet printed with several cards during each game. The sheets are conventionally made of paper and are supplied in bound books of tear-off sheets. As play proceeds, the sheets are marked with a marker known as a dabber. The paper sheets are single use only, thus creating a great deal of waste paper over a session of bingo games.

In addition to the large amount of waste generated, there is a significant cost to the bingo operator in purchasing and maintaining a stock of books of sheets. Control of the paper sheets is a further problem, as an individual sheet acquired without proper payment could be played without being identified.

The present invention proposes a reusable sheet that mitigates problems with the prior art.

SUMMARY

According to the present invention there is provided a game sheet comprising of flexible synthetic plastic material and bearing permanent markings delineating plural markable areas of the sheet, and having a top surface that will accept temporary, erasable markings.

The sheet is preferably transparent polyvinyl chloride (PVC) with an anti-glare surface, for example a matt finish. It has been found that certain grades of PVC used as sheet protectors will provide the flexibility and strength required. At the same time, the matt finish will not key to markings made with dry erase markers but will unexpectedly allow their erasure. It has also been found that markings made on this material with permanent markers can be removed using a dry erase marker as a solvent. The sheets are reverse printed.

According to another aspect of the present invention there is provided a game book comprising a plurality of sheets of flexible synthetic plastic material, each sheet bearing permanent markings delineating plural markable areas thereon, each sheet having a top surface that will accept temporary erasable markings, and binding means binding the sheets together along one edge of the book.

The binding means may be any suitable binding, for example a coiled wire binding wound through holes in the edge of the book, or heat sealing along one edge of the book.

BRIEF DESCRIPTION OF THE DRAWINGS

In the accompanying drawings, which illustrate an exemplary embodiment of the present invention.

DETAILED DESCRIPTION

Figure 1:
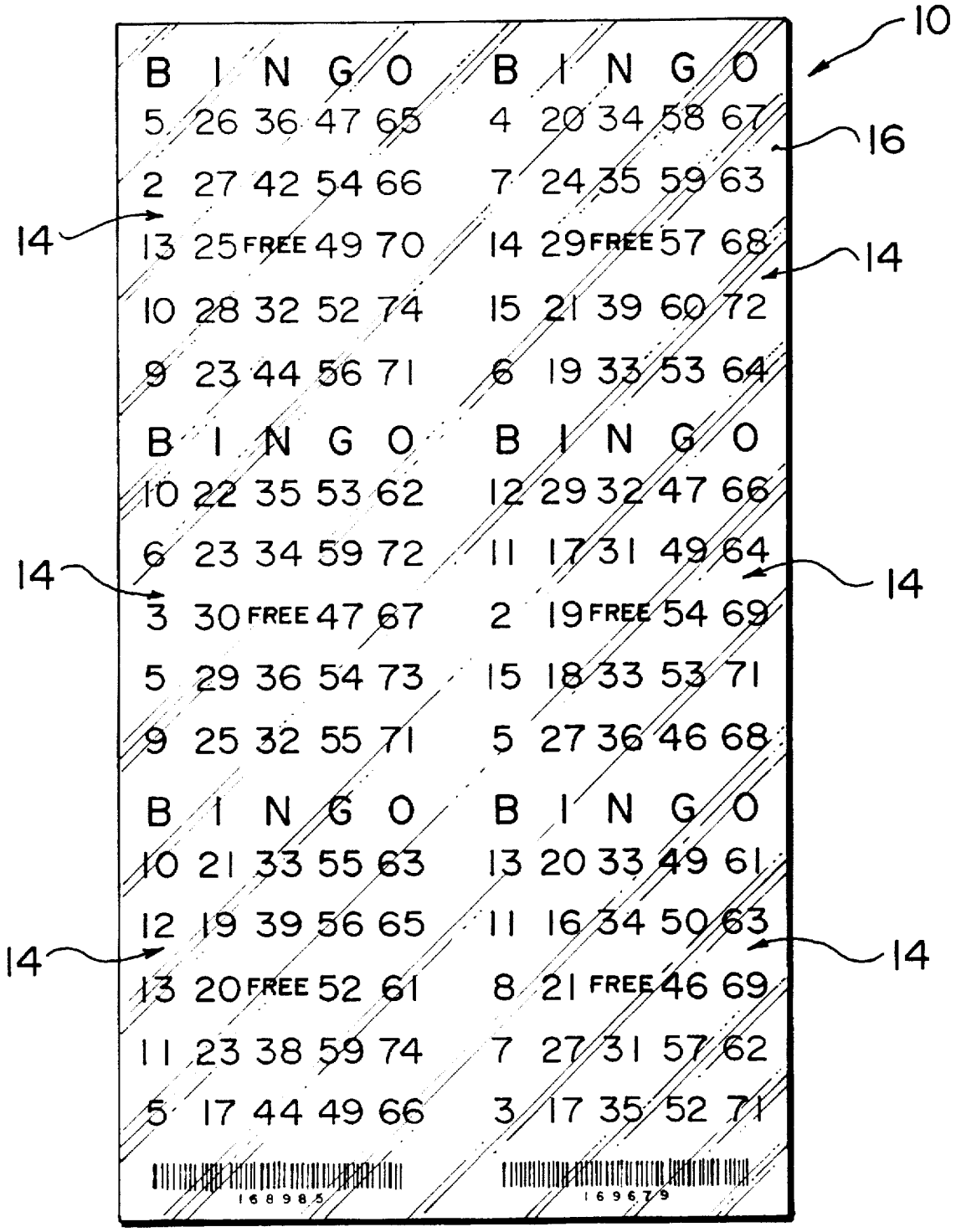
FIG. 1 is a plan view of a sheet according to the present invention.
Figure 2:
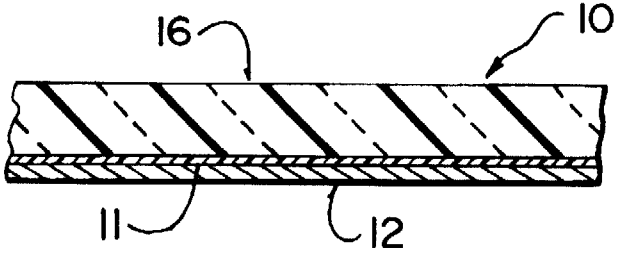
FIG. 2 is an enlarged sectional view of the sheet.

Referring to the accompanying drawings, FIGS. 1 and 2 illustrate a game sheet 10 of transparent PVC. The sheet is reverse printed, that is it has layers of printing 11 on the back side 12, with a set of bingo cards 14. The front side 16 of the sheet is a smooth, unmarked anti-glare surface. It is receptive to marking with a solvent-based marker.

Figure 3:
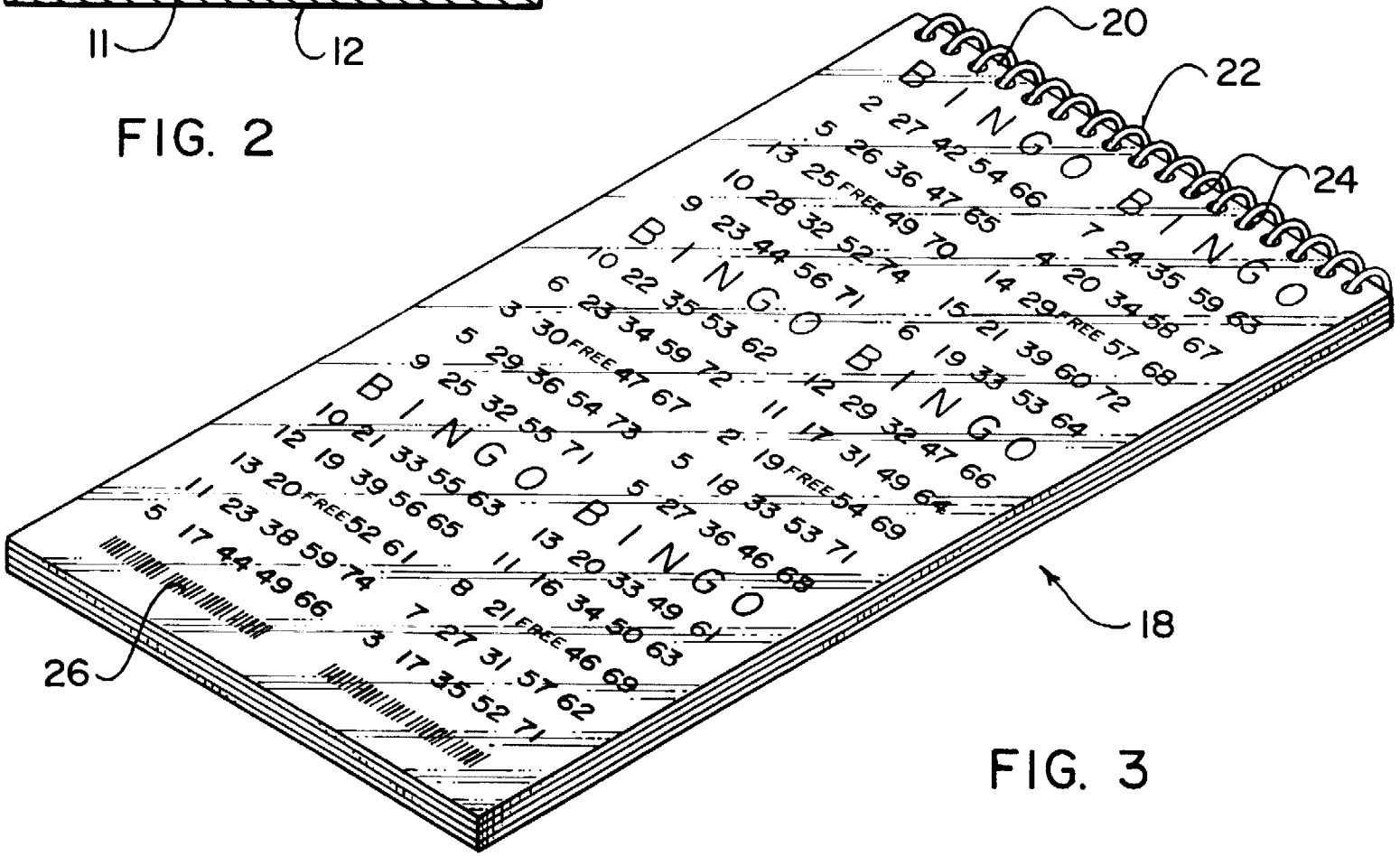
FIG. 3 is an isometric view of a book of sheets.

FIG. 3 illustrates a set of these sheets bound into a book 18 along a back edge 20 of the book. The binding is a plastic coil 22 wound through holes 24 along the back edges 20 of the sheets.

Each sheet in the book is marked to be distinguishable from the other sheets, by printing the sheets with different colours. A bar code 26 is printed on each sheet for inventory control purposes.

In other embodiments of the book, another type of binding may be used, for example heat sealing along the back edge 20 of the book.

With the reusable sheets and books of the invention, the need to acquire a large inventory of books is eliminated. With a limited number of books available, control of inventory becomes practical. Each book is marked with an inventory control identifier, the bar code 26, which may be used to ensure that payment has been received for all of the books played.

While one particular embodiment of the invention has been described in detail in the foregoing, it is to be understood that the invention is not limited to that embodiment. Other embodiments are possible within the scope of the invention. The invention is to be considered limited solely by the scope of the appended claims.

I claim:

1. A game sheet for use in bingo comprising;

a sheet of flexible, transparent PVC with top and bottom surfaces, the a top surface having an anti-glare finish that is adapted to accept temporary, erasable markings of a solvent based marking material and to allow the solvent-based marking material to be erased therefrom; and permanent markings on the bottom surface delineating plural bingo cards, each with columns of numbered areas.

2. A game book for use in bingo comprising:

a plurality of sheets of flexible transparent PVC with top and bottom surfaces, the a top surface having an anti-glare finish that is adapted to accept temporary, erasable markings of a solvent based marking material and to allow the solvent-based marking material to be erased therefrom; and permanent markings on the bottom surface of each sheet, the markings delineating plural bingo cards, each with columns of numbered areas and including means for distinguishing each sheet from each other sheet; and binding means binding the sheets together along one edge of the book.

3. A book according to claim 2 wherein the binding means comprise a plurality of holes spaced along said one edge of the book and a coil wound through said holes.

4. A book according to claim 2 wherein the binding means comprise heat sealing along said one edge of the book.

5. A book according to claim 2 wherein the means for distinguishing each sheet from each other sheet comprise markings of different colors on the respective sheets.

6. A book according to claim 2 wherein the means for distinguishing each sheet from each other sheet comprise bar codes marked on the sheets.

* * * * *